US007468495B2

(12) United States Patent
Carbone et al.

(10) Patent No.: US 7,468,495 B2
(45) Date of Patent: Dec. 23, 2008

(54) MULTI-MODE CONVECTION OVEN WITH FLOW CONTROL BAFFLES

(75) Inventors: Philip C. Carbone, North Reading, MA (US); Matthew E. Brekken, Arlington, MA (US); Peter F. Pescatore, Wakefield, MA (US); David M. Martin, Acton, MA (US); Anindya Boral, Arlington, MA (US)

(73) Assignee: Viking Range Corporation, Greenwood, MI (US)

( * ) Notice: Subject to any disclaimer, the term of this patent is extended or adjusted under 35 U.S.C. 154(b) by 151 days.

(21) Appl. No.: 11/159,974

(22) Filed: Jun. 23, 2005

(65) Prior Publication Data

US 2006/0289436 A1 Dec. 28, 2006

Related U.S. Application Data

(60) Provisional application No. 60/678,317, filed on May 6, 2005.

(51) Int. Cl.
*A21B 1/26* (2006.01)
*F24C 15/32* (2006.01)

(52) U.S. Cl. ..... 219/400; 99/476; 126/21 A

(58) Field of Classification Search ..... 219/400
See application file for complete search history.

(56) References Cited

U.S. PATENT DOCUMENTS 1,923,145 A 8/1933 Harsch
1,940,948 A 12/1933 Harsch
3,861,378 A * 1/1975 Rhoads et al. ..... 126/21 A
3,905,760 A 9/1975 Johansson et al.
4,029,463 A * 6/1977 Johansson et al. ..... 126/21 A
4,587,946 A * 5/1986 Doyon et al. ..... 126/20
4,779,604 A * 10/1988 Konig ..... 126/21 A
4,984,557 A * 1/1991 Konig ..... 126/21 A
6,727,478 B2 * 4/2004 Rael et al. ..... 219/506
6,730,880 B2 * 5/2004 Smith et al. ..... 219/400
6,730,881 B1 * 5/2004 Arntz et al. ..... 219/400
6,805,112 B2 * 10/2004 Cole et al. ..... 126/21 A
6,854,456 B1 * 2/2005 Friedrich et al. ..... 126/21 A
2004/0200362 A1 * 10/2004 Leppich et al. ..... 99/476
2005/0005781 A1 * 1/2005 Ohtsuka et al. ..... 99/476

FOREIGN PATENT DOCUMENTS

EP 1 437 552 A1 7/2004

* cited by examiner

*Primary Examiner*—Joseph M Pelham
(74) *Attorney, Agent, or Firm*—Womble Carlyle Sandridge & Rice, PLLC

(57) ABSTRACT

An airflow control system for an oven having an oven cavity and a fan having a first operating mode for generating a first flow of air and a second operating mode for generating a second flow of air is provided. A baffle is included adjacent the fan to direct the first flow of air to a first region of the cavity in the first operating mode and to direct the second flow of air to a second region of the cavity in the second operating mode. A method of controlling airflow in an oven having an oven cavity is also detailed. The method can include different modes of operation, with different clockwise and counter-clockwise rotational times for the fan, with different heating elements energized, or a combination of both, depending upon the food to be cooked in the oven.

32 Claims, 17 Drawing Sheets

MULTI-MODE CONVECTION OVEN WITH FLOW CONTROL BAFFLES

CROSS-REFERENCE TO RELATED APPLICATIONS

This application claims the benefit of U.S. Provisional Application 60/678,317, filed May 6, 2005, incorporated by reference herein in its entirety.

FIELD OF THE INVENTION

This invention relates generally to cooking appliances, and more specifically to convection ovens.

BACKGROUND OF THE INVENTION

Ovens have long been used for cooking. Several types of conventional ovens exist. One is a convection oven, which features a fan designed to circulate air within the oven cavity creating convection currents. The fan also circulates the air past a heating element that heats the air to cooking temperatures; typically several hundred degrees. The hot circulating air currents pass over and around food in the oven cavity to facilitate cooking. Convection oven cooking is considered by many to be superior to standard radiant oven cooking.

Conventional convection ovens suffer from a number of drawbacks. For example, some conventional ovens heat food by circulating air in one direction around stationary food. The unidirectional path or stream of the airflow can result in unevenly cooked food. More specifically, the portion of the food facing or directly in the path of the hot airflow generally will heat quicker than portions of the food shielded from or not directly in the path of the airflow. Some conventional convection ovens attempt to solve this disproportional quicker cooking of one portion of the food by providing a reversing fan, which is intended to reverse the direction of the airflow periodically. However, these reversing fan systems alone have not been controlled adequately and fail to circulate a sufficient amount of heated air evenly throughout all regions of the oven cavity. Consequently, hot spots and uneven cooking still occurs. Further, airflow generally is directed from the sides of the fan cowling, which can result in uneven distribution of hot air and regions of stagnation in the oven.

Many conventional convection ovens also fail to provide an adequate variety of cooking modes customized to various foods that may be cooked in the oven. Simple convection ovens, for example, usually have a single direction airflow path with a fan operated by a timer or by a watchful user and function to cook food for a set or predetermined period of time. Convection ovens with a reversing fan also operate in many instances for a set period of time, albeit with periodically reversing flow, until the food has cooked. This rather simple timed oven operation offers limited control and is not highly adaptable to the many types of food that may be cooked in the oven. As a result, the preparation of food in these ovens is largely relegated to trial and error, experience, and much supervision. Even more sophisticated convection ovens with some cooking mode selections have had insufficient variations of cooking modes and inadequate coordination of the various heating sources to provide highly precise and adaptable cooking.

Accordingly, a need exists for an oven that addresses successfully the foregoing and other problems and shortcomings of the prior art. It is to these provisions of such ovens that the present invention is primarily directed.

SUMMARY OF THE INVENTION

Briefly described, the present invention, in one preferred embodiment thereof, comprises an improved airflow control system for a convection style oven. The oven has an oven cavity and a fan disposed in the cavity for circulating heated air within the cavity. The fan has a first operating mode for generating a first flow of air and a second operating mode for generating a second flow of air. A unique baffle system is disposed adjacent the fan. The baffle system is configured to direct the first flow of air to a first region of the oven cavity when the fan is in its first operating mode. The baffle system is configured to direct the second flow of air to a second region of the oven cavity when the fan is in its second operating mode. The system preferably includes a motor that is controlled to switch the fan between its first and second operating modes. Generally, operation of the fan in either a clockwise or a counterclockwise direction distinguishes the operating modes. The motor is capable of selectively changing operation of the fan from its first operating mode to its second operating mode and from its second operating mode to its first operating mode. Further, a time delay can be included between either switching the fan from the first operating mode to the second operating mode or switching the fan from the second operating mode to the first operating mode. This time delay functions to allow the fan motor to reset before operating in the opposite direction.

In one embodiment, the baffle system in conjunction with the fan is capable of redirecting the majority of the airflow, for example approximately 70%, from the first region of the cavity to the second region of the cavity when the system switches from the first operating mode to the second operating mode. Likewise, the baffle is capable of redirecting the majority of the air, for example approximately 70%, from the second region of the cavity to the first region of the cavity when the system switches from the second operating mode to the first operating mode. In general, the baffle has two outlets for air and, when the system is switched between the first and second operating modes, the airflow is directed respectively through the first and second outlets. Further still, the baffle includes areas that are sealed off from the cavity of the oven. These sealed off areas also form a housing for the fan. The sealed off areas of the outlets and the baffle design provide bottom and side openings for the first and second outlets that are in airflow communication with the cavity of the oven. Generally, the side openings formed by the baffle are larger than the bottom openings. In one embodiment, the fan is surrounded by a heating element and includes a fan blade that is about eight inches in diameter.

The invention also includes a method of controlling airflow in a convection oven having an oven cavity. The method includes operating a fan disposed in the cavity in a first operating mode to generate a first flow of air. The first flow of air is directed to a first region of the cavity with a baffle disposed adjacent the fan. The fan is then operated in a second operating mode to generate a second flow of air, with the second flow of air is directed to a second region of the cavity by the baffle. The fan is operated by a motor that is controlled to switch the fan between its first and second operating modes. Further, the fan can be paused between its first and second operating modes if desired.

The combination of the large fan blade and baffle design allows the selected mode of oven operation to cook food accurately and evenly due, in part, to a more evenly distributed airflow and fewer hot spots and stagnant zones within the oven cavity.

The invention further includes a variety of precise cooking modes achieved by carefully considered coordination of convection distributed heat and radiated heat from unique multiple section heating elements, as detailed below.

These and additional features, objects, and advantages of the invention will become more apparent upon review of the detailed description set forth below in conjunction with the accompanying drawing figures, which are briefly described as follows.

DETAILED DESCRIPTION OF THE PREFERRED EMBODIMENTS

Figure 1:
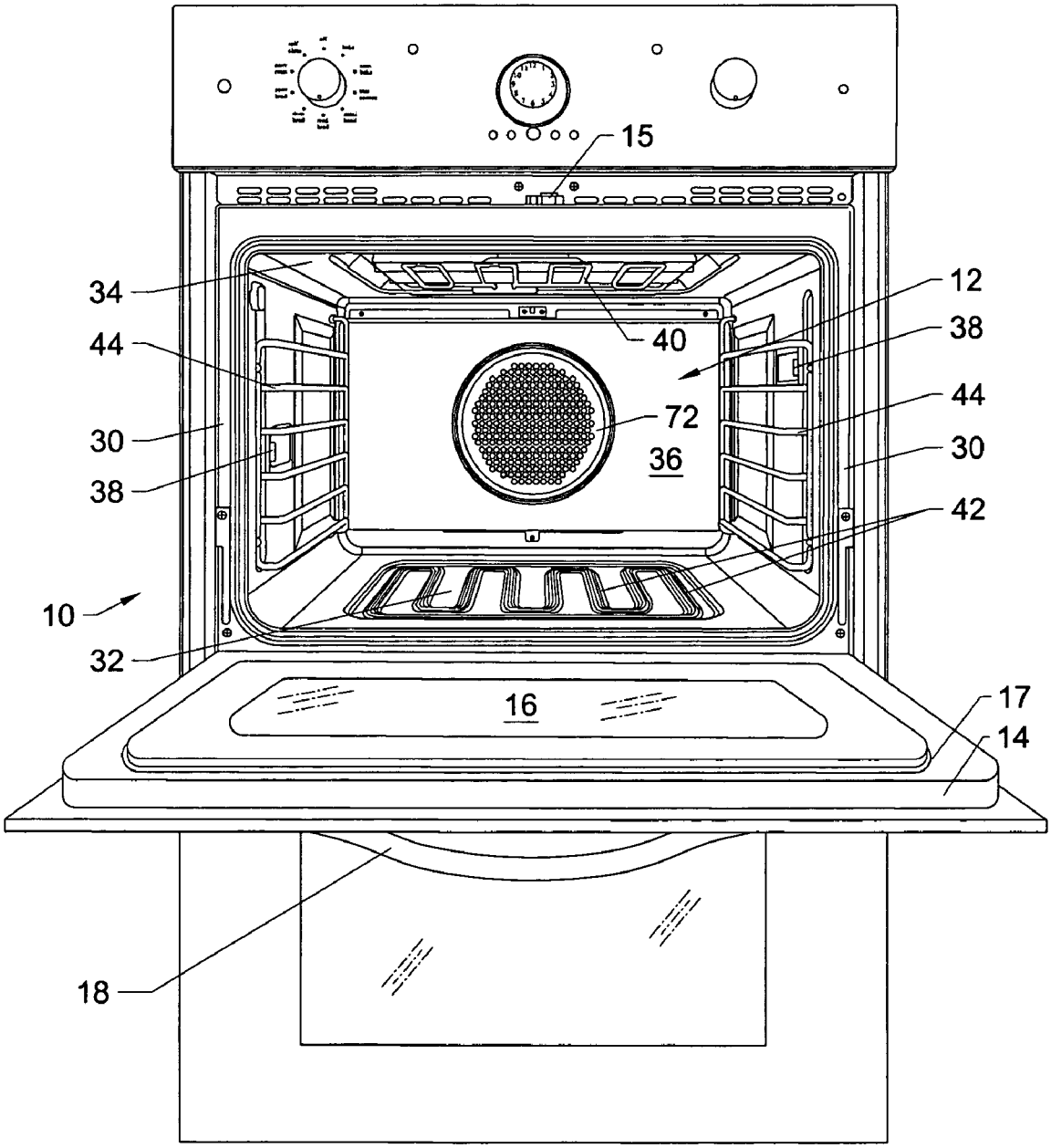
FIG. 1 is a front view of a convection oven.

Referring now in more detail to the drawing figures, wherein like reference numerals refer, where appropriate, to like parts throughout the several views, the figures illustrate an oven that embodies principles of the invention in preferred forms.

FIG. 1 shows a front view of an oven 10 that includes an oven cavity 12 and a door 14. The door 14 can include a seal 17, which assists in sealing the space between the door and the cavity when the door 14 is in a closed position. The door 14 is hingeable, generally within a range of at least 90°, to operate from a closed to an open position or an open to closed position. As shown in FIG. 1, when the door 14 is in an open position, the oven is capable of receiving items, such as food or other substances to be heated, in the cavity 12.

The door 14 can include any number of conventional features, such as a window 16 and a handle 18 as shown in FIG. 1. The door 14 generally includes a glass pack and other features that insulate the door 14 and allow it to remain relatively cool in comparison to the temperature in the cavity 12 of the oven 10. The window 16 allows viewing of food in the oven cavity 12. A light 38 can be provided in the cavity 12 and can be controlled by a switch or other operational assembly, such as on a control panel 20. The light 38 could also be operated via opening or closing of the door 14. The control panel 20 can include any number of knobs, dials, displays, or other operational devices that enable a user to select a cooking mode, to set a timer, to turn on or off a light, or to perform any other features provided by the present oven.

A lock assembly 15 can be included at a center portion of the upper part of the cavity 12. The lock assembly 15 interacts with the door 14 when it is in a closed position. The lock assembly 15 secures the door in a locked position when necessary due to the temperature in the oven cavity 12 or when initiated by a user. For example, when the oven 10 is operated in a self-cleaning mode, the temperature within the oven cavity 12 typically will be elevated and could harm persons or items exterior to the oven if the door 14 were opened. In the self-cleaning mode, the lock assembly 15 can secure the door 14 in a closed position until the temperature in the oven cavity 12 cools to an unharmful level. Although a single lock assembly 15 is shown in FIG. 1 in the center portion of the upper exterior part of the cavity 12, the lock assembly 15 can include any number of lock assemblies and can be disposed anywhere around the periphery of the cavity 12.

Figure 2:
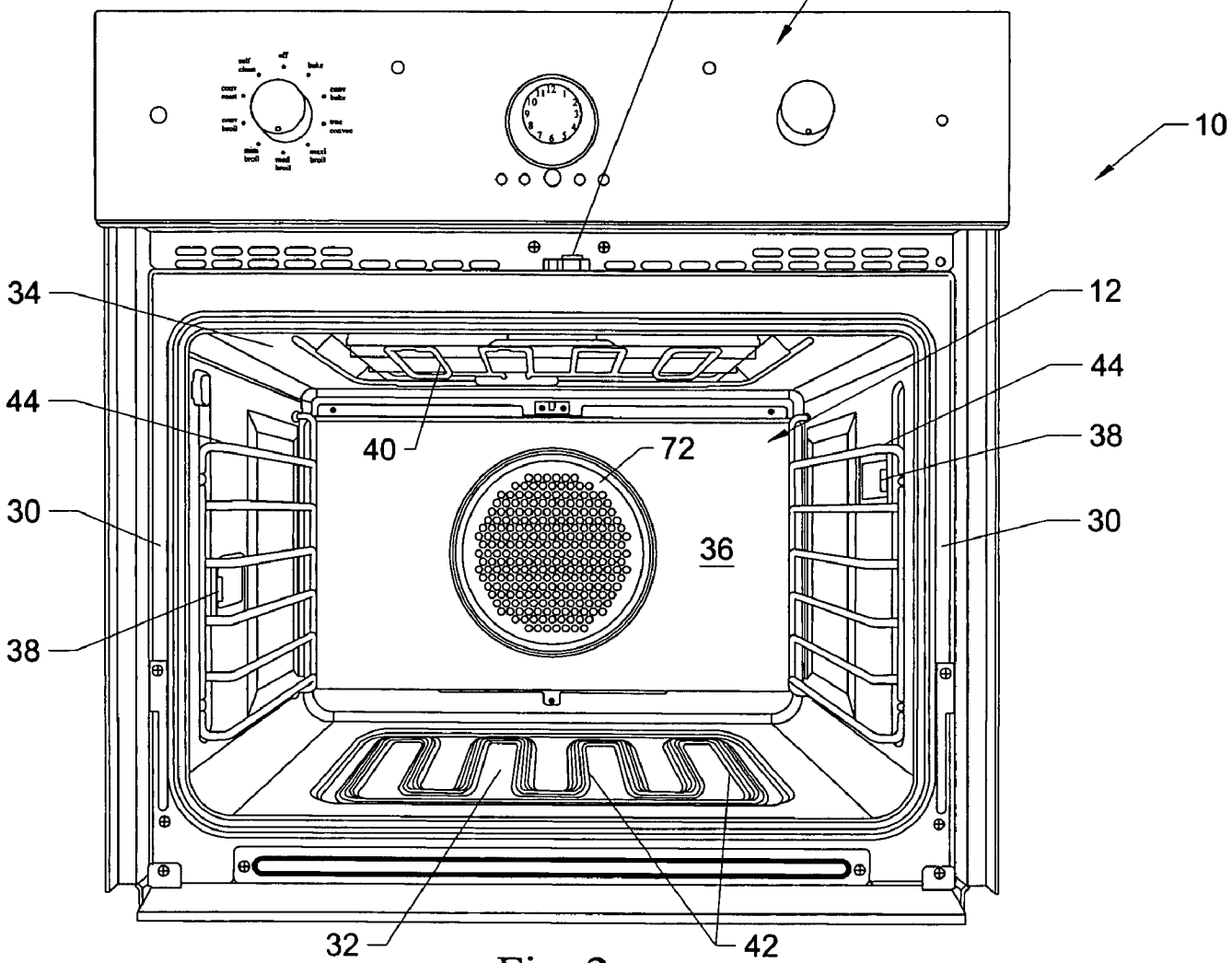
FIG. 2 is a close-up view of the oven of FIG. 1 with the door of the oven removed.

FIG. 2 is a close-up view of the oven cavity 12 with the door removed. The oven cavity 12 is bounded and enclosed by at least six generally flat walls. One wall is the inside face of the door 14 when it is closed. The cavity 12 also includes opposing sidewalls 30, a bottom wall 32, a top wall 34, and a back wall 36. The light 38 is shown in sidewalls 30, but can be disposed anywhere, and in any number within the cavity 12. FIG. 2 also shows inner and outer broiling elements 40, 41 adjacent top wall 34, inner and outer baking elements 42, 43 adjacent bottom wall 32, and segmented rack holders 44 adjacent side walls 30. Rack holders 44 are capable of receiving racks (not shown) in various configurations as required by the food to be cooked in the oven 10. In the preferred embodiments, the rack holders 44 are shown configured for six rack positions, generally numbered from 1 to 6 with 6 being the top rack position. Broiling elements 40, 41 and baking elements 42, 43 can be configured in any desired shape, orientation, number, size, or position. The heating elements, specifically broiling elements 40, 41 and baking elements 42, 43, are made up of inner and outer elements with at least 10 passes in a coiled configuration to provide for uniform radiation of heat within the cavity 12. The broiling elements 40, 41 and baking elements 42, 43 can comprise more or less elements than shown. The heating elements are capable of independent operation and generally are controlled by control panel circuitry and logic (not shown) to operate differently in different cooking modes, as described in more detail below. The inner and outer broil elements can be exposed to the oven cavity 12 or covered, with the dual element (front and back) designs supplying sufficient heat to the cavity 12 for cooking. The broiling elements 40, 41 and baking elements 42, 43 typically are covered with a cover (not shown).

Figure 3:
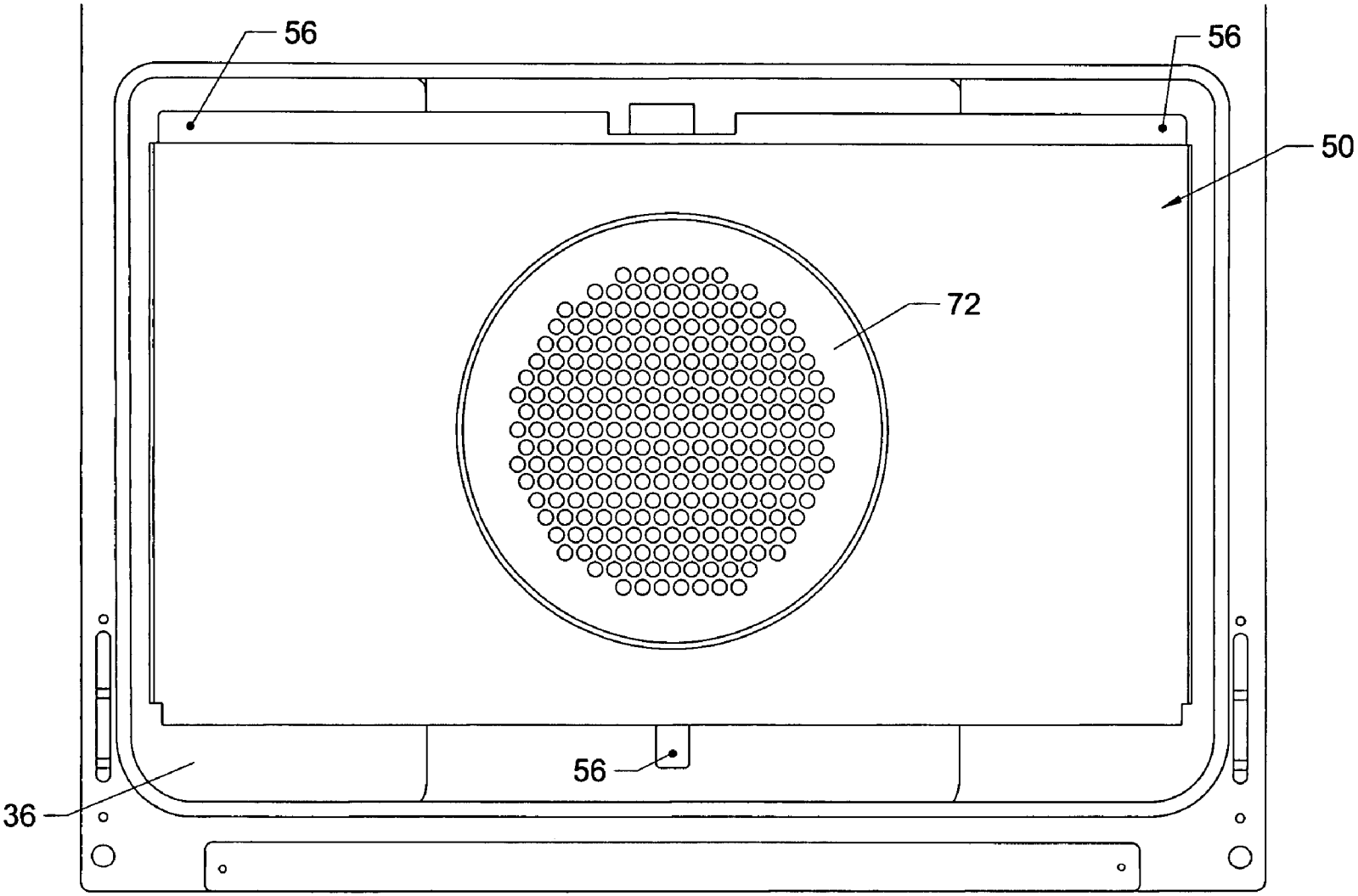
FIG. 3 is a front plan view of the oven cavity side of a baffle assembly.

FIG. 3 shows a view of the oven cavity side of a baffle assembly. The baffle assembly generally includes a baffle housing 50 secured within the cavity 12 with fasteners 56 through fastener apertures 58. Fastener apertures 58 are shown disposed in three positions along the periphery of the baffle housing 50. As will be understood by those of ordinary skill in the art, the fastener apertures 58 can be disposed in any number and in any orientation around the periphery of the baffle housing 50 or in any other orientation or position capable of securing the baffle assembly within the cavity 12 of the oven 10. As shown in the figures, generally, the baffle assembly is disposed adjacent the back wall 36.

Figure 4:
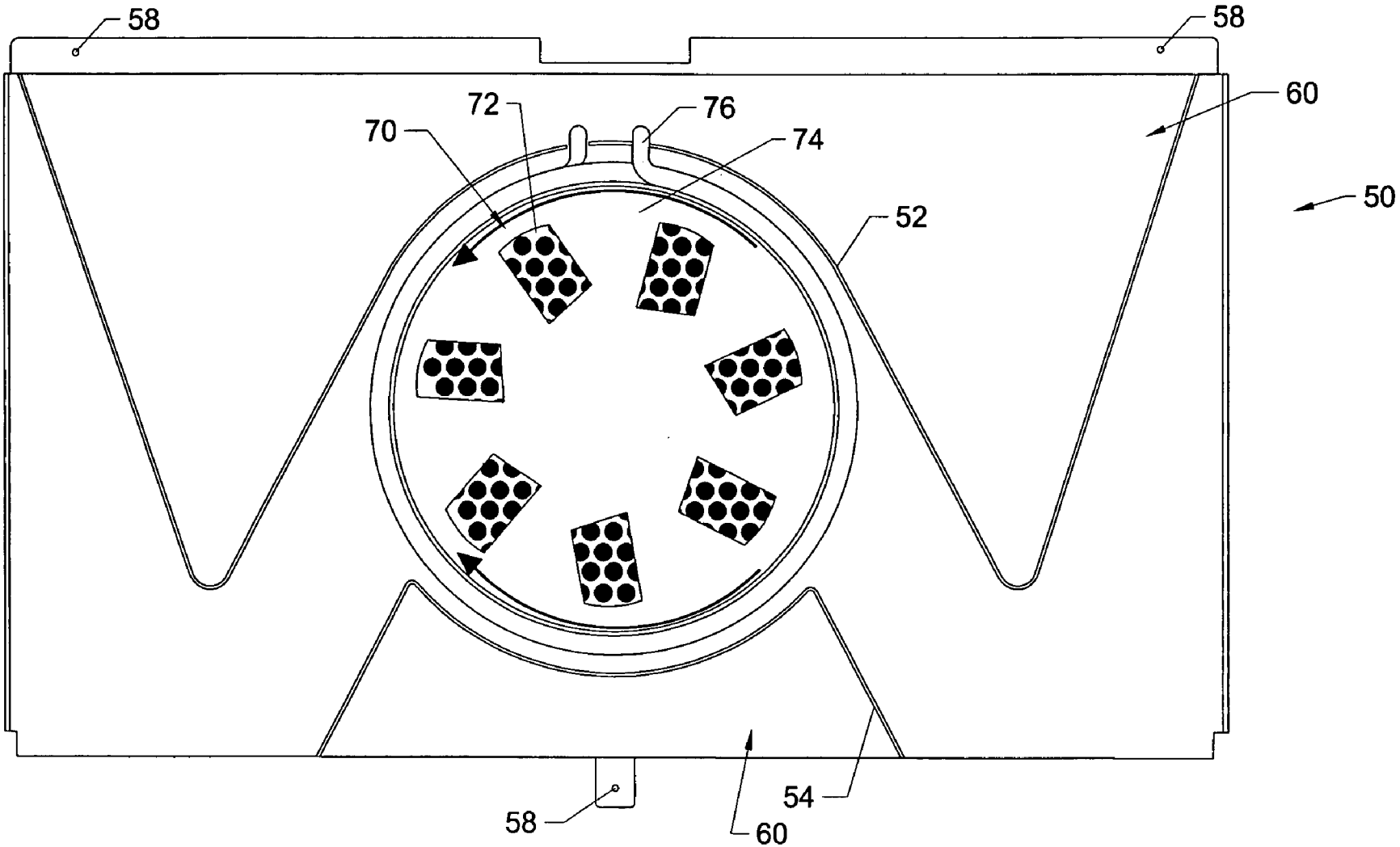
FIG. 4 is a rear view of the baffle assembly of FIG. 3.
Figure 5:
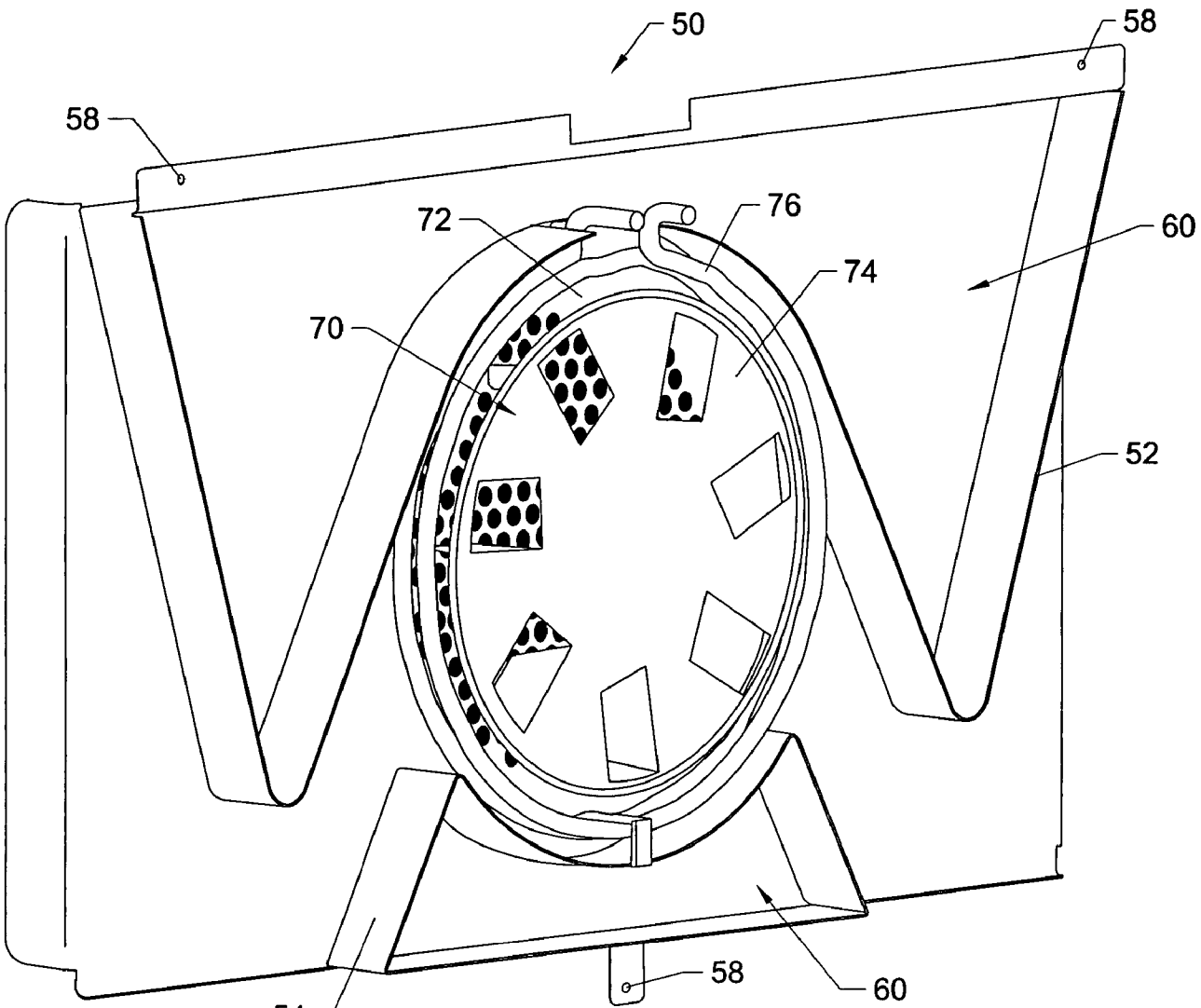
FIG. 5 is a perspective view of the fan and baffle assembly of the invention.

FIGS. 4 and 5 show a view of the wall side of the baffle assembly of FIG. 3. As shown in FIG. 4, the baffle housing 50 generally comprises an upper baffle 52 and a lower baffle 54. Although the upper baffle 52 and lower baffle 54 can be formed in any orientation capable of providing control of the airflow in the cavity 12, the baffle design shown in FIG. 4 includes substantially similar left and right portions of the upper baffle 52 and the lower baffle 54. The similar left and right portions of the upper baffle 52 include V-shaped portions with an interior angle of approximately 30° and a total arc width of approximately 45°. When the baffle housing 50 is secured adjacent the back wall 36 in the cavity 12, the upper baffle 52 and lower baffle 54 provide sealed off areas 60 through which airflow does not pass. The baffle assembly generally comprises a sheet metal or other component baffle system with upper and lower flow baffle components. The design of the baffle assembly includes air outlets on either side that are rather pronounced due to the larger diameter of the fan blade 74 and consequently large airflow volume. The baffle also includes an analogous outlet that is pronounced due to the diameter of the fan blade 74.

As shown in FIGS. 4 and 5, the orientation of the upper baffle 52 and the lower baffle 54 creates a housing for a fan assembly 70. The fan assembly 70 generally includes a fan blade 74 that operates to draw air through a grill cover 72. The grill cover 72 can be a portion separate from the baffle housing 50 or can be an integral part of the baffle housing 50 with a side facing the cavity 12 and with a wall facing side. The air drawn through the grill cover 72 can be heated by a heating element 76, shown in the figures around the fan blade 74. The fan assembly 70 generally operates continuously in a periodically reversing manner during convection mode operation of the oven. However, generally the fan is programmed to pause for a period of time, for example approximately 10 seconds, before reversing from one rotational direction to the opposite direction. This pause or delay is implemented to prevent sudden high torque stresses and to avoid burning out or otherwise harming motor 82.

Figure 6:
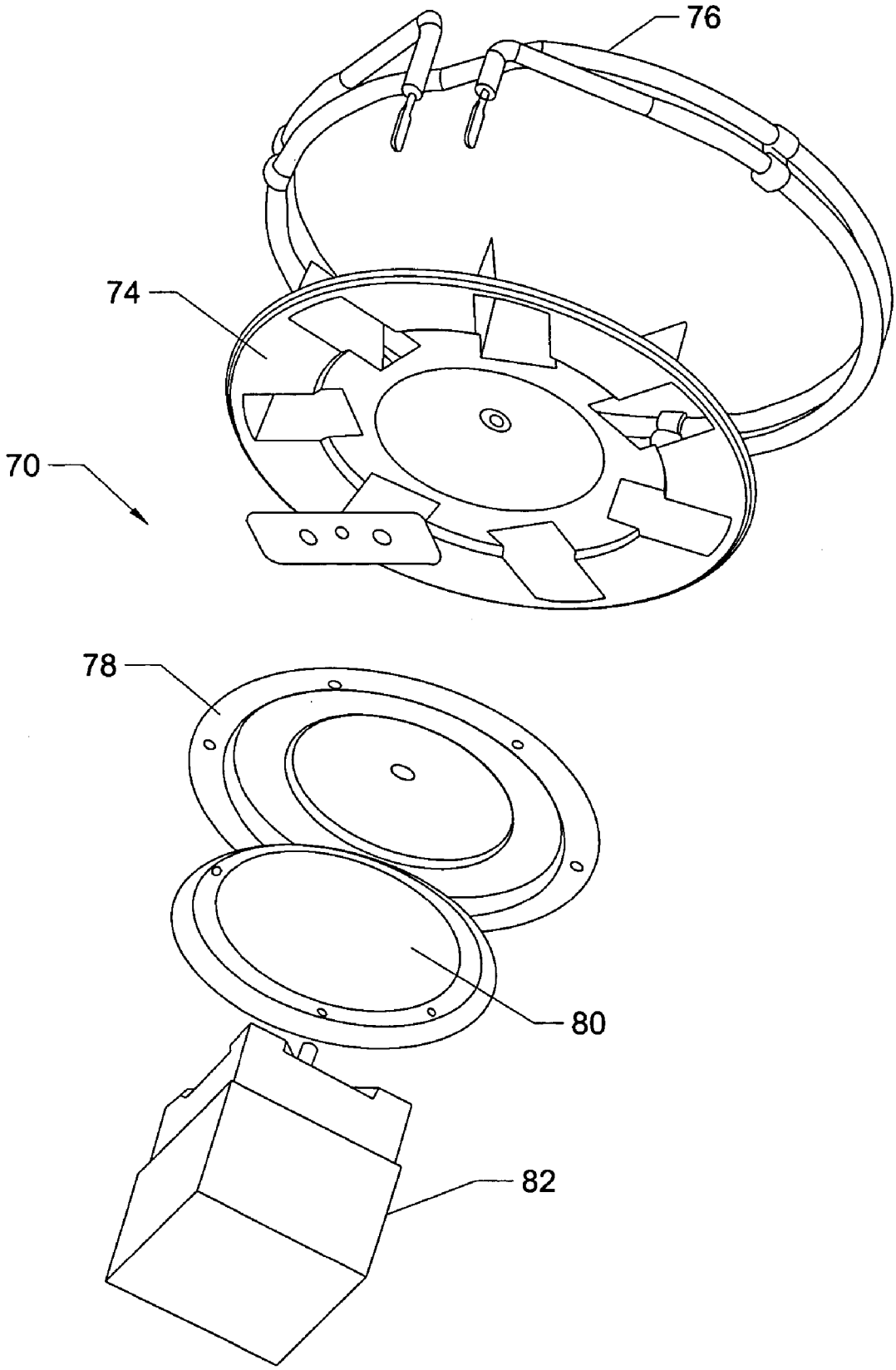
FIG. 6 is an exploded view of a fan assembly.

FIG. 6 shows an exploded view of the fan assembly 70, which includes fan blade 74, heating element 76, cavity mounting plate 78, motor mounting plate 80, and motor 82. The mounting plate 78 and 80 are provided to connect the fan assembly 70 to the motor 82. The motor 82 generally is a reversing motor, which is capable of rotating the fan 74 in either a clockwise or counterclockwise direction. Generally, the fan is operated between two speed ranges, for example, between 1900-2200 rotations per minute (rpm) and 2300-2600 rpm. These ranges allow control and operation of the oven 10 in a number of different modes that provide different sequences, different timing, and different operation modes of the fan within set or specific temperature ranges. Thus, the lower fan speed generally is used for convection baking and the higher fan speed generally is used for convection roasting or convection broiling. Since the fan assembly incorporates a relatively large fan blade 74 (as shown in the figures, the fan blade has at least approximately an 8 to 8.5 inch outer diameter), the fan assembly 70 is capable of generating approximately 150 cubic feet per minute (cfm) of airflow at approximately 1900 rpm.

When the baffle system is secured within the oven cavity 12 and the fan blade 74 is operated in either the clockwise or counterclockwise direction, the baffle assembly is capable of directing airflow in a specific direction to a specific region of the cavity 12. If the fan is operating in a clockwise rotation, the baffle assembly generally directs the majority of the air (for example, approximately 70%) to the right side and right bottom region of the oven cavity 12. If the fan is operating in a counterclockwise direction, the baffle assembly generally directs the majority of the air (for example, approximately 70%) to the left side and left bottom region of the cavity 12 of the oven 10. Since the design of the baffle assembly includes a pronounced air outlet on both sides due to the larger diameter of the fan blade 74 and its high flow volume, the outlet area from the fan blade is only approximately 40% of the inlet area to the fan. The relatively smaller outlet area compared to inlet area creates higher outlet velocities that assist in pushing the airflow to the front of the oven to improve uniformity of flow and evenness of cooking within the cavity 12. These higher outlet velocities from the baffle assembly allow for higher and more even air velocity across the food in the oven cavity 12. When the motor 82 rotates the fan blade 74, the majority of the airflow exiting the baffle is directed to a particular side and bottom region of the oven at any particular time. This airflow allows for higher localized heat transfer rates and for a more even air flow distribution around the food or other articles to be heated in the oven 10. The localized heat transfer rates are higher than in prior conventional convection ovens due to the change of the direction of the fan blade 74 and consequent airflow change, allowing the food to receive higher localized rates of heat only for about half the cooking time. In other words, the reversing fan assembly provides an increased pulse (for example, an "on" pulse of 60-second duration) of a higher localized heat transfer rate when the airflow is in a first direction coupled with a greatly reduced heat transfer rate (for example, an "off" pulse of 60-second duration) when the air flow is in the opposite direction. These higher localized heat transfer rates improve the evenness of cooking while maintaining desired baking speeds. In the present system of cooking, different cooking modes that include different combinations of times and fan speeds can be used to achieve reductions in cooking times. For example, the convection roast and convection broil as detailed below utilize a second, higher fan speed to achieve a reduced cooking time in comparison to conventional systems that only operate with one fan speed.

Figure 7:
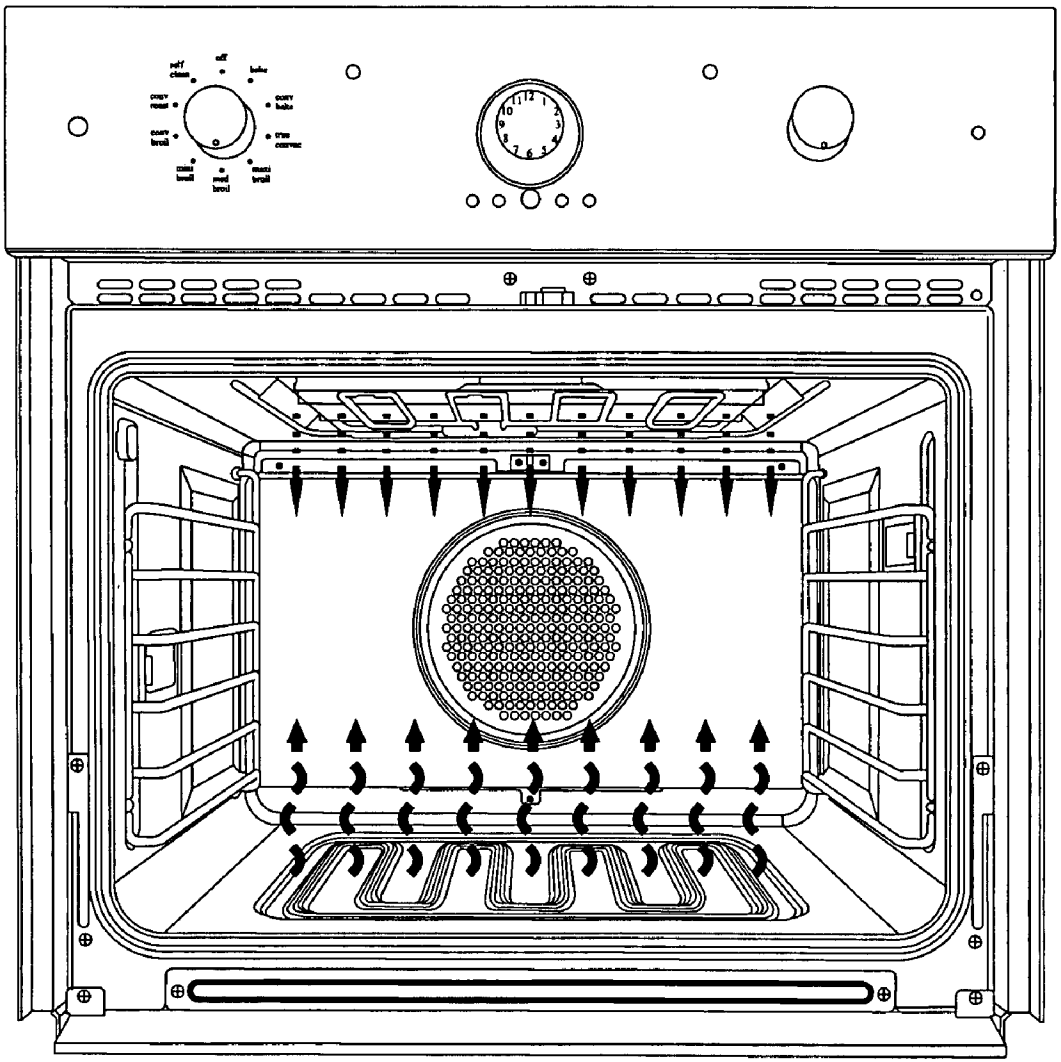
FIG. 7 shows an exemplary bake mode of operation.

FIGS. 7-14 provide eight exemplary modes of operation that a user can select to cook food or other items in the oven cavity 12. FIG. 7 shows an exemplary bake mode of operation. In the bake mode, the broil elements and baking elements are operated to provide ample, gentle heating to the oven cavity 12. The inner and outer bake elements operate at approximately 88% of full power in baking mode. In bake mode, the lower bake elements 42, 43 operate with the inner bake element being on approximately 40% of the time and the outer bake element being on approximately 45% of the time. The inner and outer broil elements 40, 41 are also operated, with the inner broil element operating for approximately 3 seconds at a time and the outer broil element operating for approximately 2 seconds at a time. The bake mode of operation shown in FIG. 7 can be utilized to cook delicate foods (e.g., angel food cake) and less delicate foods (e.g., biscuits).

Figure 8:
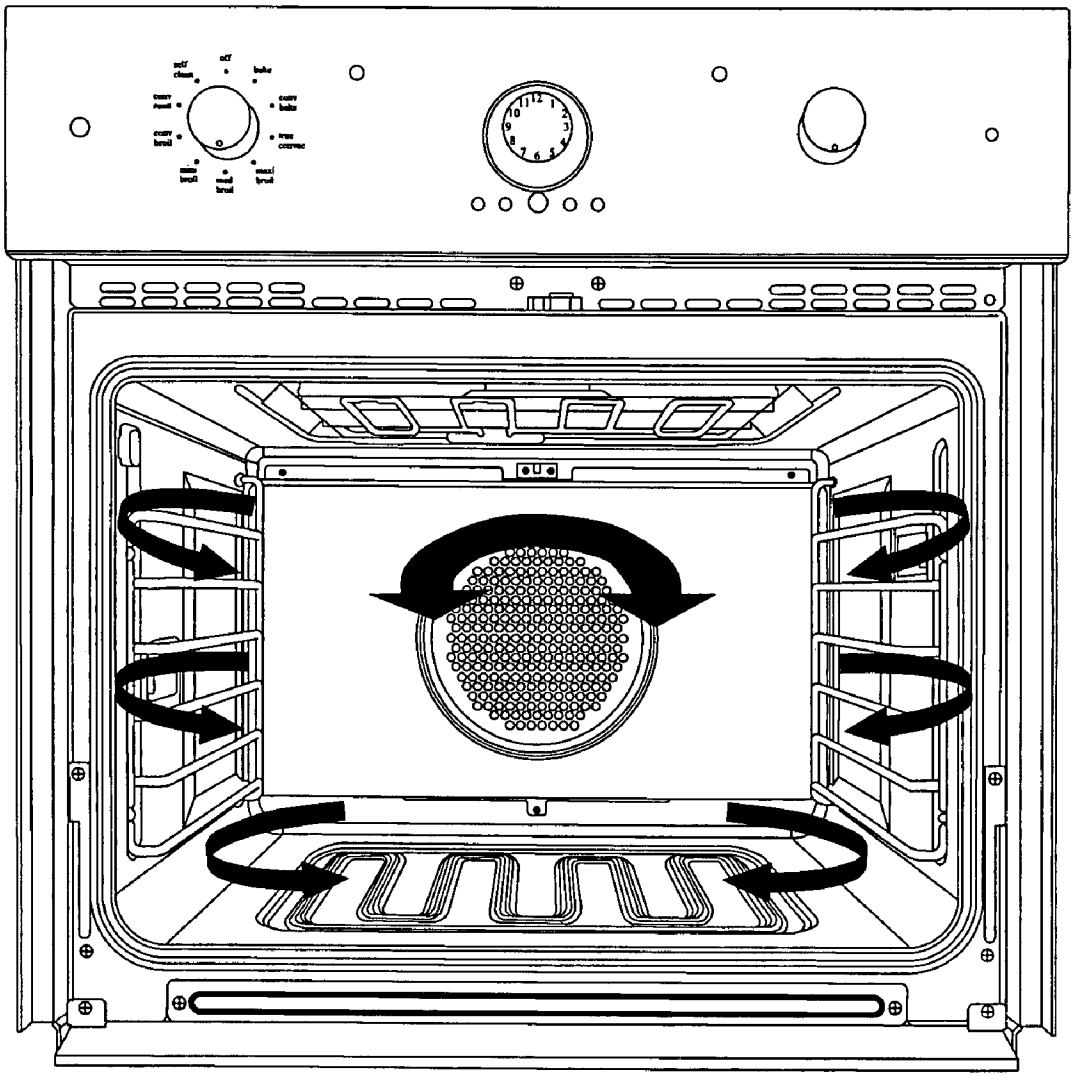
FIG. 8 shows an exemplary true convection mode of operation.

FIG. 8 shows an exemplary true convection (Tru Convec) mode of operation. As shown by the arrows in FIG. 8, the reversing fan is operated by motor 82 with the large fan blade 74 being capable of providing an increased and controllable airflow to each side and bottom region of the oven cavity. The convection element 76, provided around the fan blade 74, provides all of the heating in this Tru Convec mode. Generally, the convection heating element 76 is a high capacity element (approximately 3000 watts) and the baffle assembly controls the flow of heated air to the side of the cavity 12 toward which the airflow is directed. In the Tru Convec mode of operation, the fan blade operates in one direction for approximately 45 seconds and then is reversed by the motor 82 to rotate in the other direction for approximately 45 seconds. The Tru Convec mode allows even baking of foods on multiple racks disposed on rack holders 44. For example, unlike conventional convection ovens, six racks of cookies or three racks of muffins can be cooked evenly at the same time in the present oven.

Figure 9:
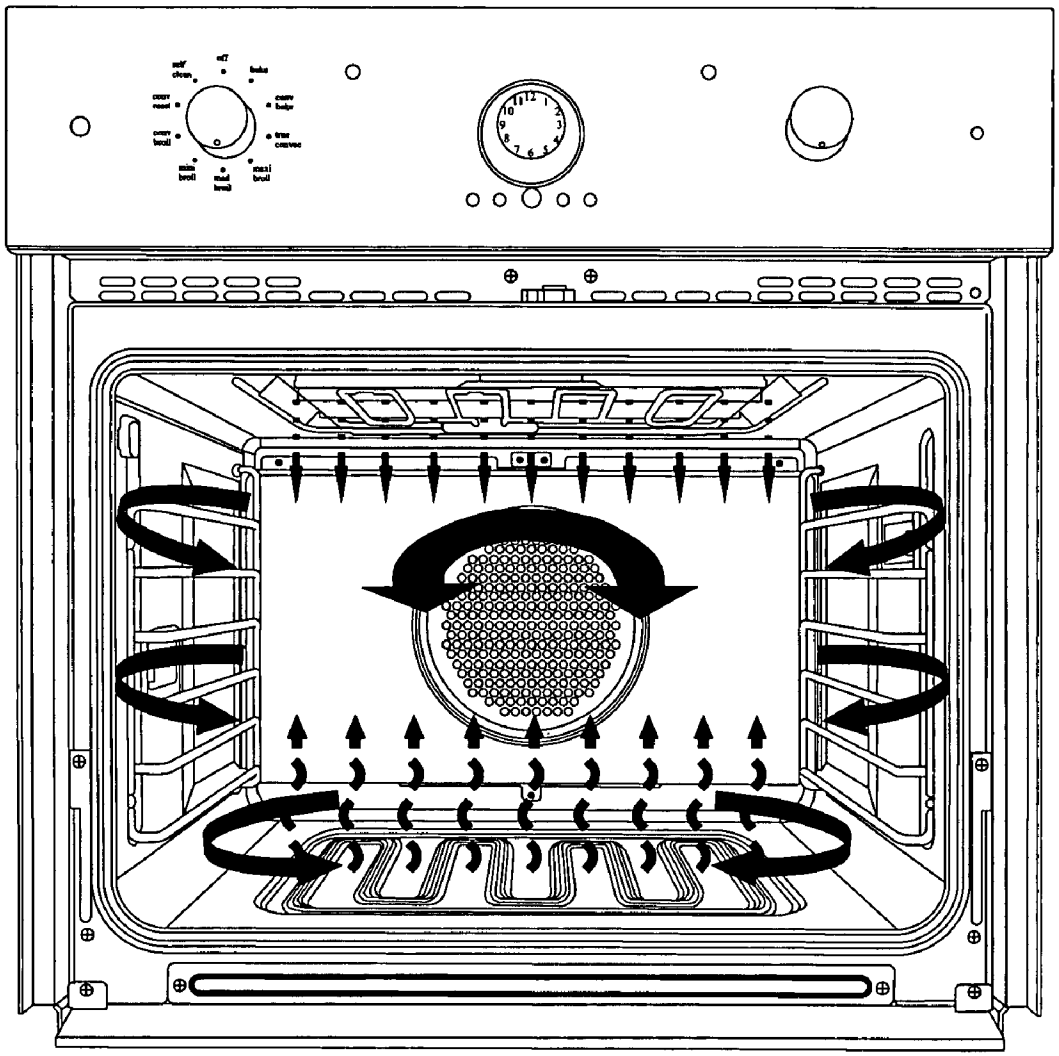
FIG. 9 shows an exemplary convection bake mode of operation.

FIG. 9 shows an exemplary convection bake mode of operation. The convection bake mode of operation is similar to the Tru Convec mode of operation as detailed in FIG. 8, but the convection bake mode of operation includes initiation of the inner broil element, inner bake element, and outer bake element for a few seconds duration. In the exemplary convection bake mode of operation shown in FIG. 9, the convection element, disposed around the reversing fan, is operated at approximately 80% of the time at full power, the inner broil element is operated at approximately 9% of the time, and the inner and outer bake elements are operated at approximately 11% of the time. In the convection bake mode of operation, the fan operates for approximately 45 seconds in one direction and then reverses to operate for approximately 45 seconds in the other direction. The addition of operation for a few seconds duration of operation of the broiling and baking heating elements generally is provided to allow improved cooking of heavier or denser foods and to provide additional browning to the top or outer surfaces of these foods.

Figure 10:
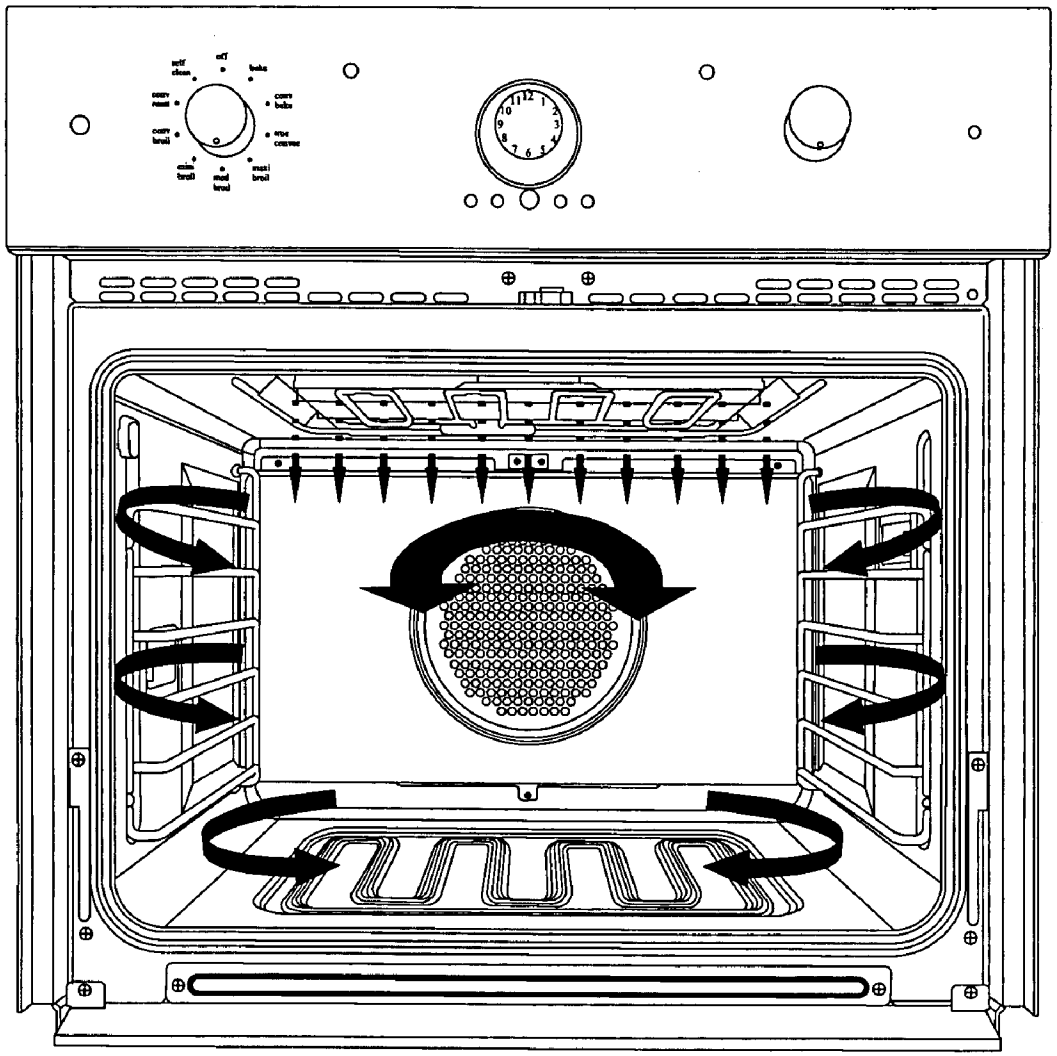
FIG. 10 shows an exemplary convection roast mode of operation.

FIG. 10 shows an exemplary convection roast mode of operation. In the convection roast mode of operation, the convection element, disposed around the fan, generally is operated at approximately 90% of the time and the inner and outer broil elements are operated at approximately 10% of the time. The reversing fan operates in one direction for approximately 60 seconds and is then reversed to operate in the other direction for approximately 60 seconds. The convection roast mode of operation generally operates the reversible convection fan at high speeds to transfer heat rapidly (mainly from the convection element 76) and thereby to allow moisture to be sealed inside large roasts or other such foods cooked in this mode of operation. The convection roast mode of operation provides approximate time savings of 10-20% over conventional single-fan convection roast modes in conventional convection ovens.

Figure 11:
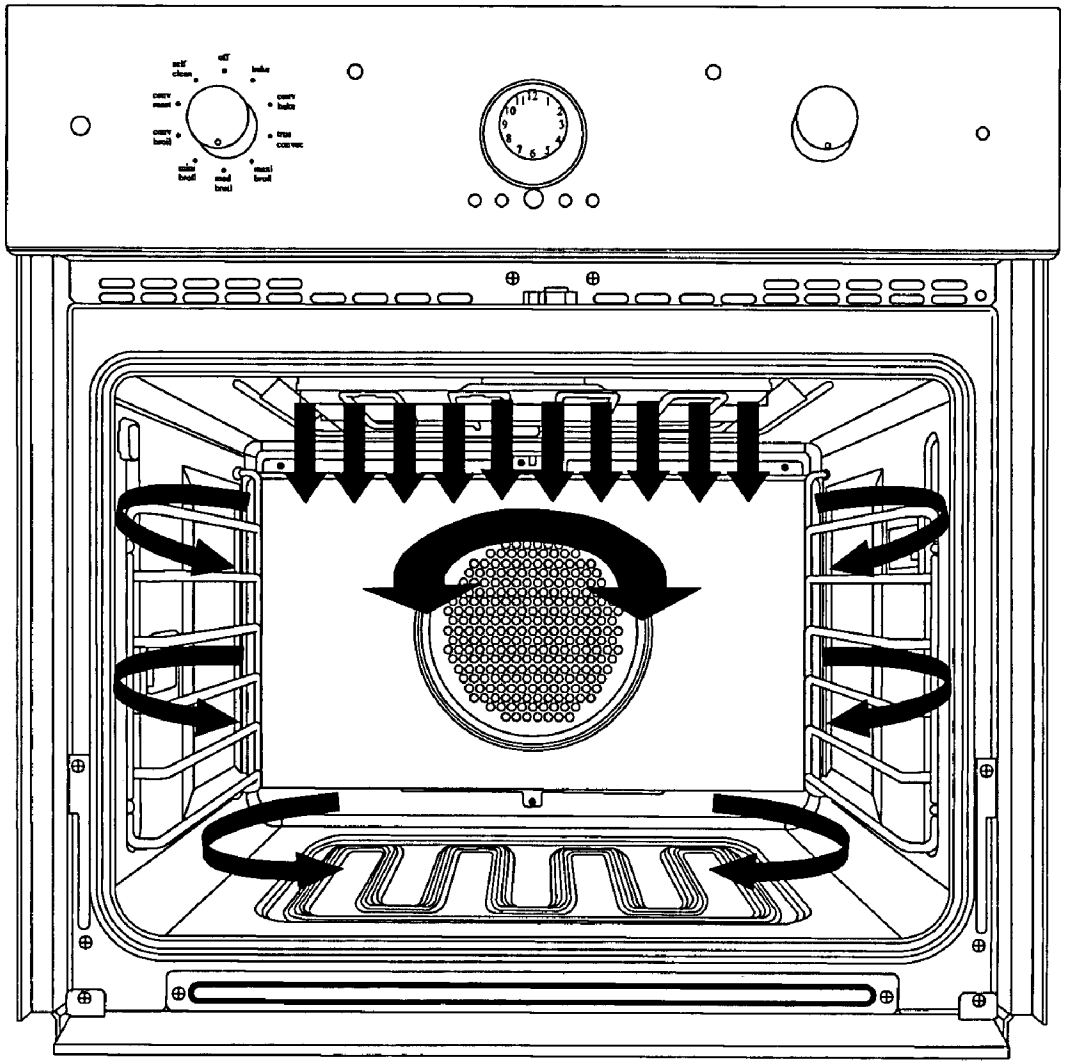
FIG. 11 shows an exemplary convection broil mode of operation.

FIG. 11 shows an exemplary convection broil mode of operation. In convection broil, the reversible convection fan operates at a higher speed to provide an airflow that supplements the radiant heat transfer of the broil element. In the convection broil mode of operation, the inner and outer broil elements are operated at full capacity approximately 100% of the time. The reversing fan in the convection broil mode of operation operates in one direction for approximately 60 seconds and then is reversed by the motor to operate in the other direction for approximately 60 seconds. The convection broil mode of operation as shown in FIG. 11 acts to reduce smoke from the food that typically is produced in convection broiling modes of operation of conventional ovens, since the airflow in the oven cavity 12 acts to reduce the peak temperatures induced in the food.

Figure 12:
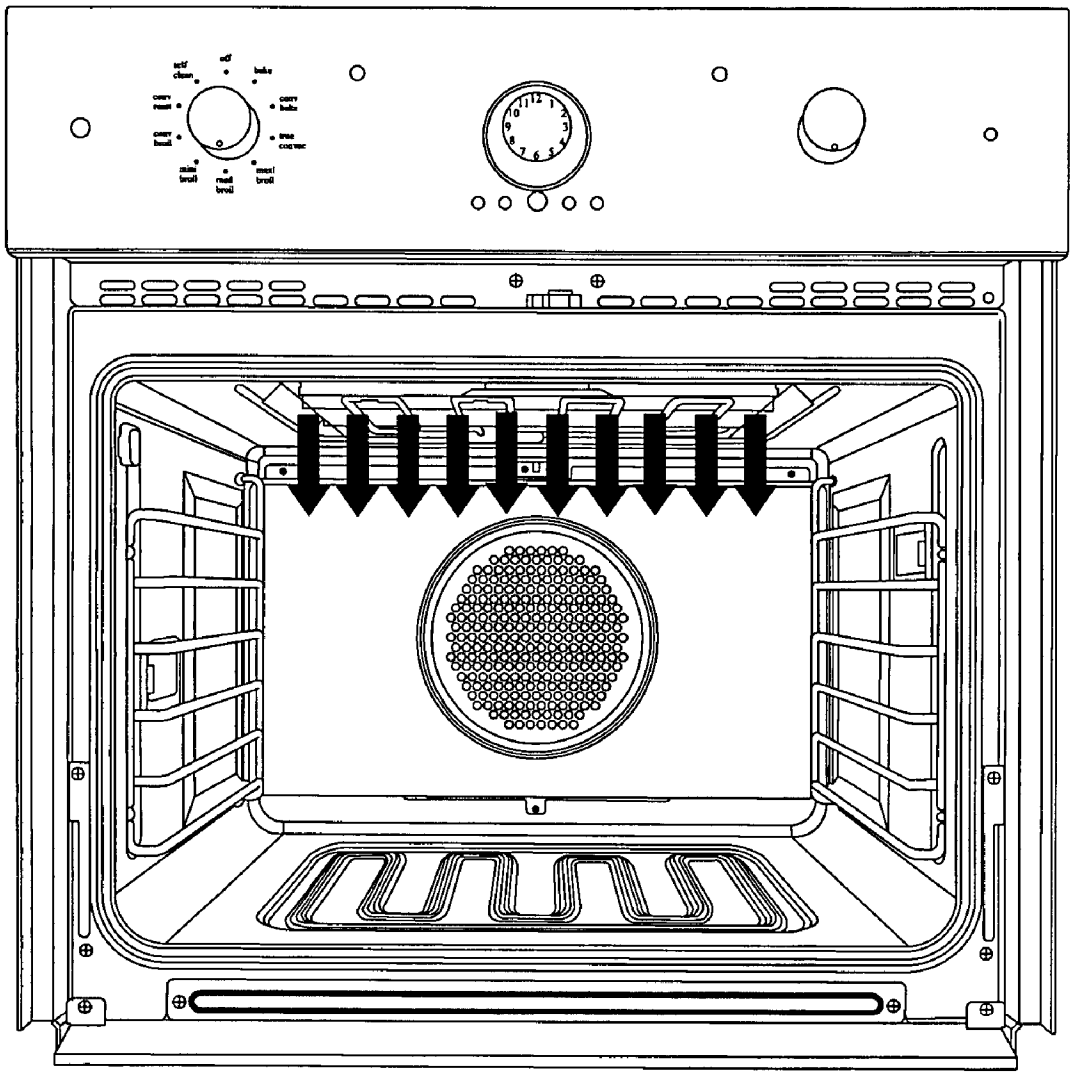
FIG. 12 shows an exemplary high broil mode of operation.

FIG. 12 shows an exemplary high broil mode of operation that utilizes the upper and lower broil elements on full power, at approximately 100%, during the entire high broil mode of operation. With both broil elements operating at all times, the elements provide intense, searing heat within the oven cavity 10 that results in "fast" broiling. The inner and outer broil elements provided in the present oven 10 cover approximately 10% or more area than conventional convection ovens, operate at approximately 4000 watts (which generally is split between the inner and outer elements with the inner element operating, for example, at approximately 2550 watts and the outer element operating, for example, at approximately 1450 watts), and provide a 10-pass dual-broil element to intensify further the heat delivered from the inner and outer broil elements. The reversing fan as shown in FIG. 12 does not operate during the high broil mode and generally the food to be broiled is positioned in a high rack position, generally at 5 or 6, depending upon the food thickness and the height of the broiler pan.

Figure 13:
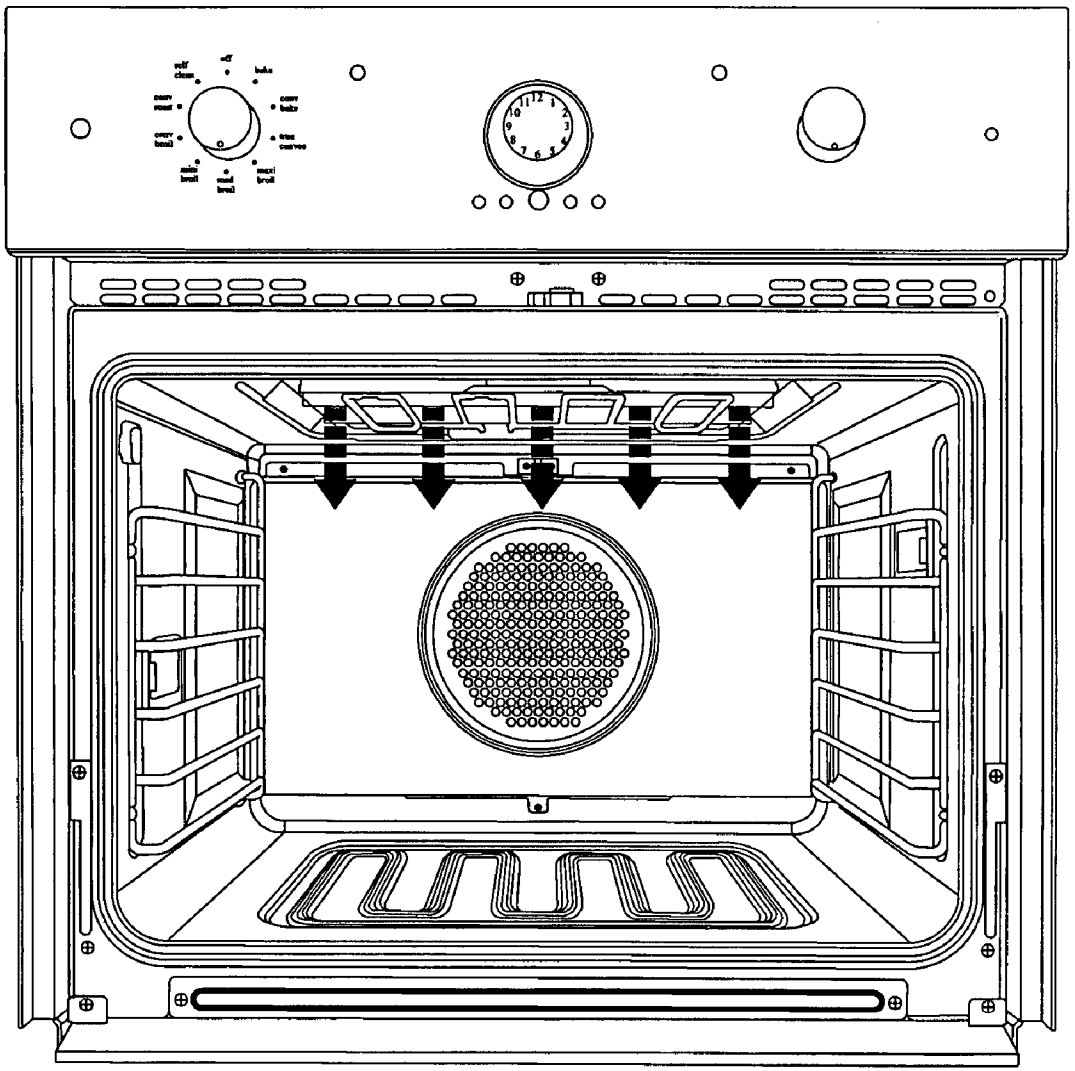
FIG. 13 shows an exemplary medium broil mode of operation.

FIG. 13 shows an exemplary medium broil mode of operation that provides a "middle ground" between the intense heat of high broil as detailed in FIG. 12 and the delicate low broil mode of FIG. 14 detailed below. In the medium broil mode of operation, the inner and outer broil elements are pulsed on and off to produce less heat than the high broil mode of operation and to promote "slow" broiling. In the medium broil mode of operation, the heating elements are on for approximately 75% of the time and generally are cycled on at alternate periods of time. As in the mode of FIG. 12, the reversing fan generally does not operate in the medium broil mode of operation and the food to be heated generally will be positioned at rack position 4, 5, or 6 depending on the type of food to be heated by the oven 10, the food thickness, and the broiler pan height.

Figure 14:
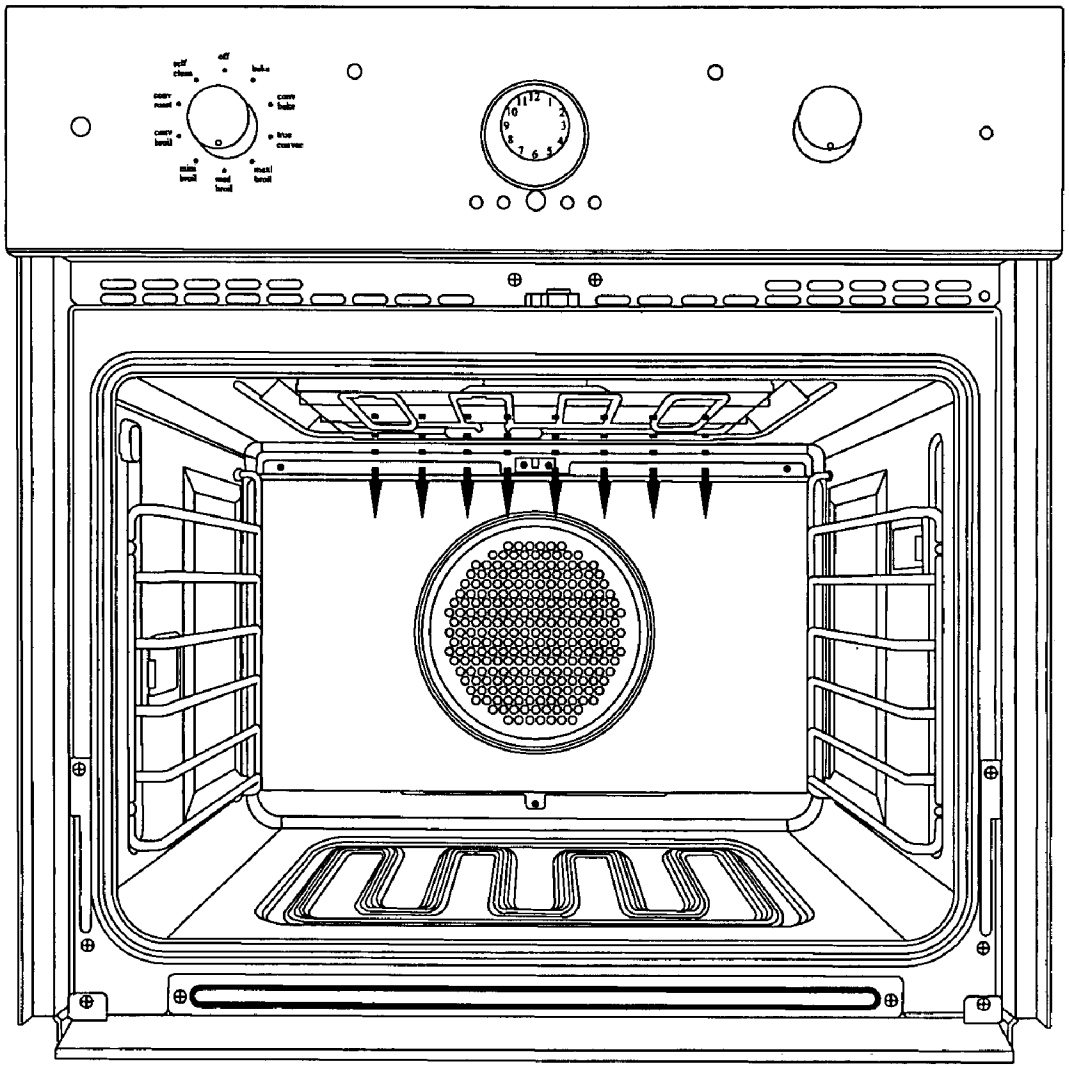
FIG. 14 shows an exemplary low broil mode of operation.

FIG. 14 shows an exemplary low broil mode of operation that is similar in operation to the high broil mode of operation detailed in FIG. 12 and the medium broil mode of operation detailed in FIG. 13. However, in the low broil mode of operation, only a fraction of the available power to the inner broil element is utilized to provide a delicate, top-browning feature to cook food gently and slowly. In the low broil mode of operation, the inner broil element operates only for approximately 40% of the total cooking time. Similar to the high broil mode of operation and the medium broil mode of operation, the reversing fan generally is not operated during the low broil mode of operation and the food to be heated generally is placed in rack positions 3 or 4 depending upon the height of the pan used and the food to be browned. The low broiling mode of operation can be used, for example, to gently brown meringue in approximately 3-4 minutes.

Figure 15A:
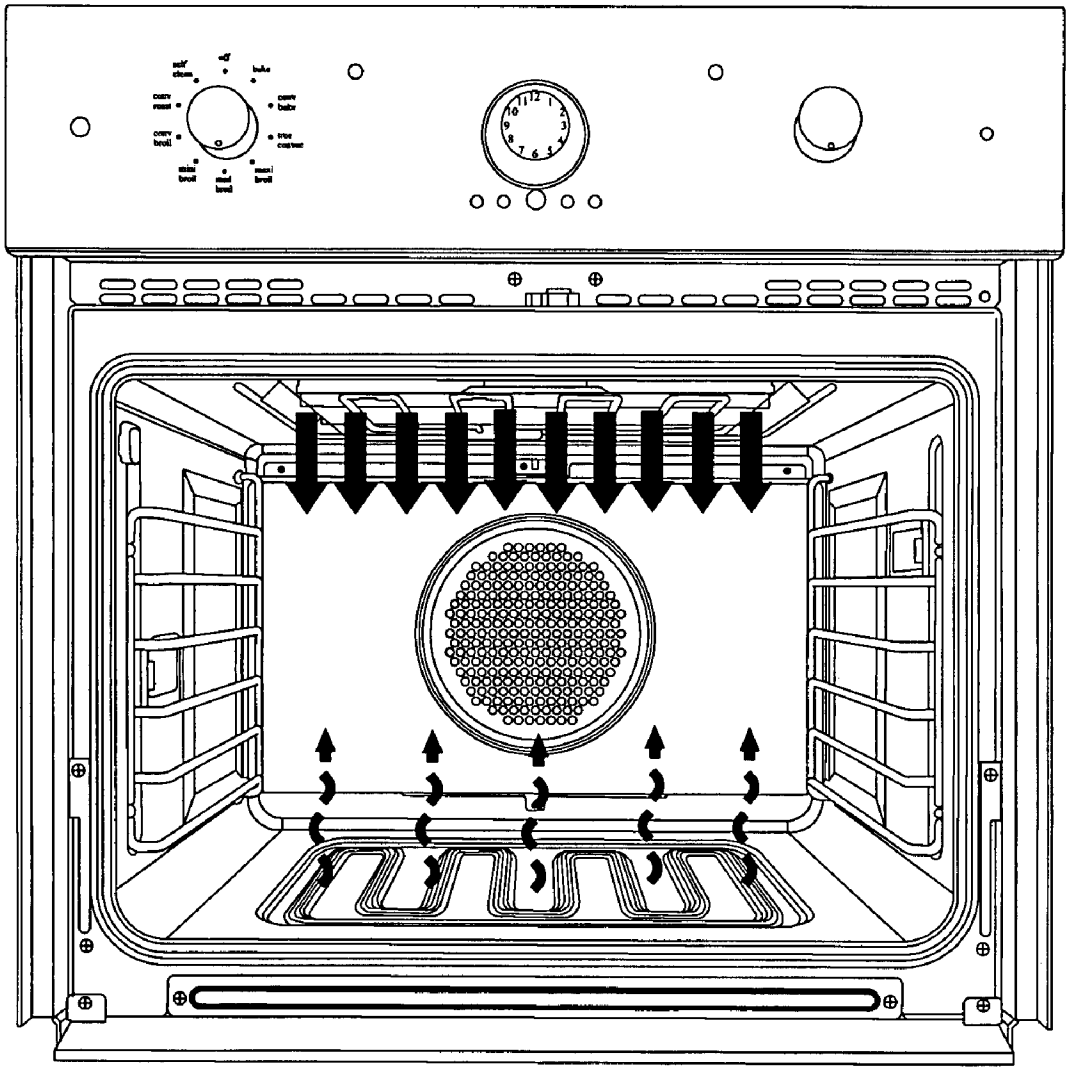
FIGS. 15A-C show an exemplary fast preheat operation sequence.
Figure 15B:
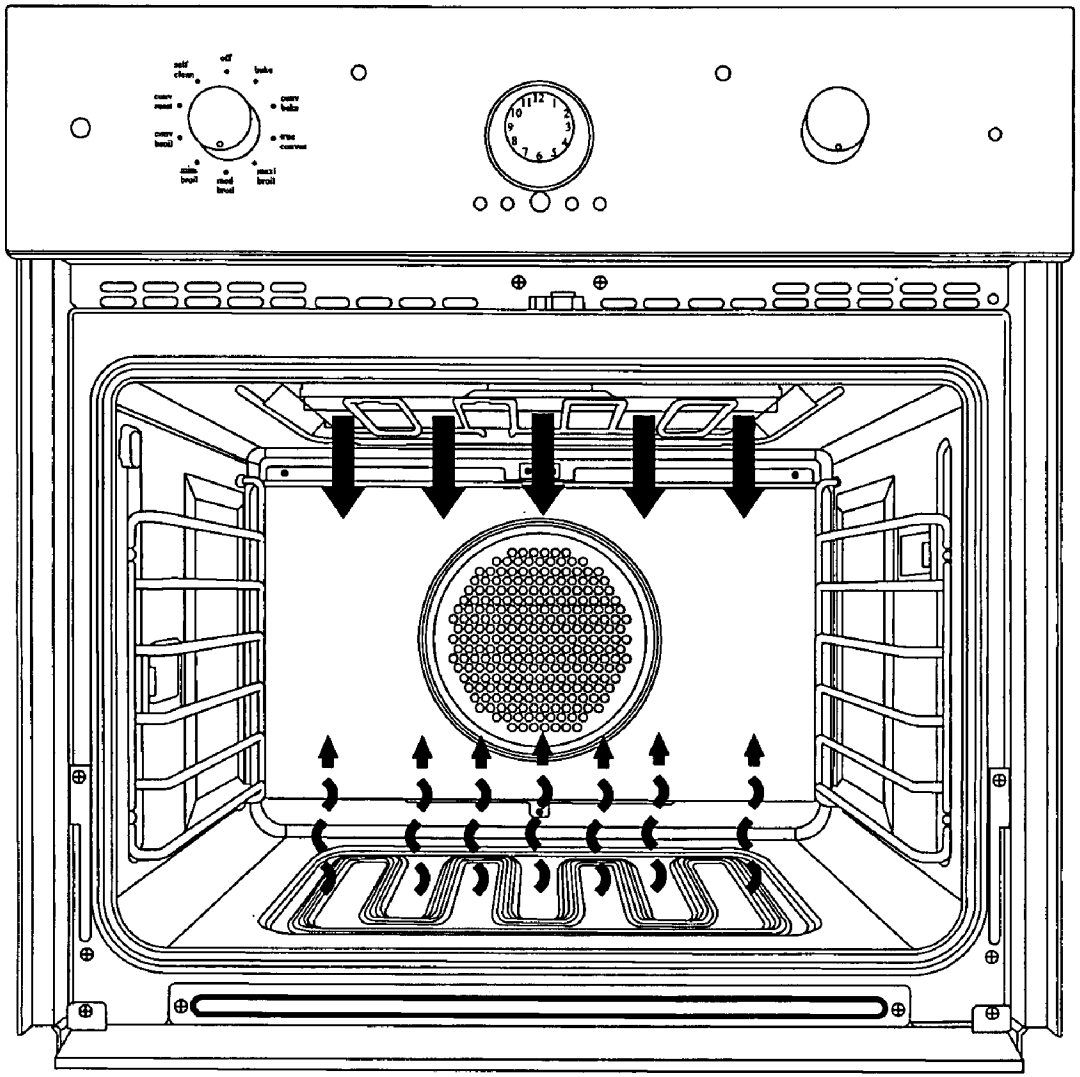
Figure 15C:
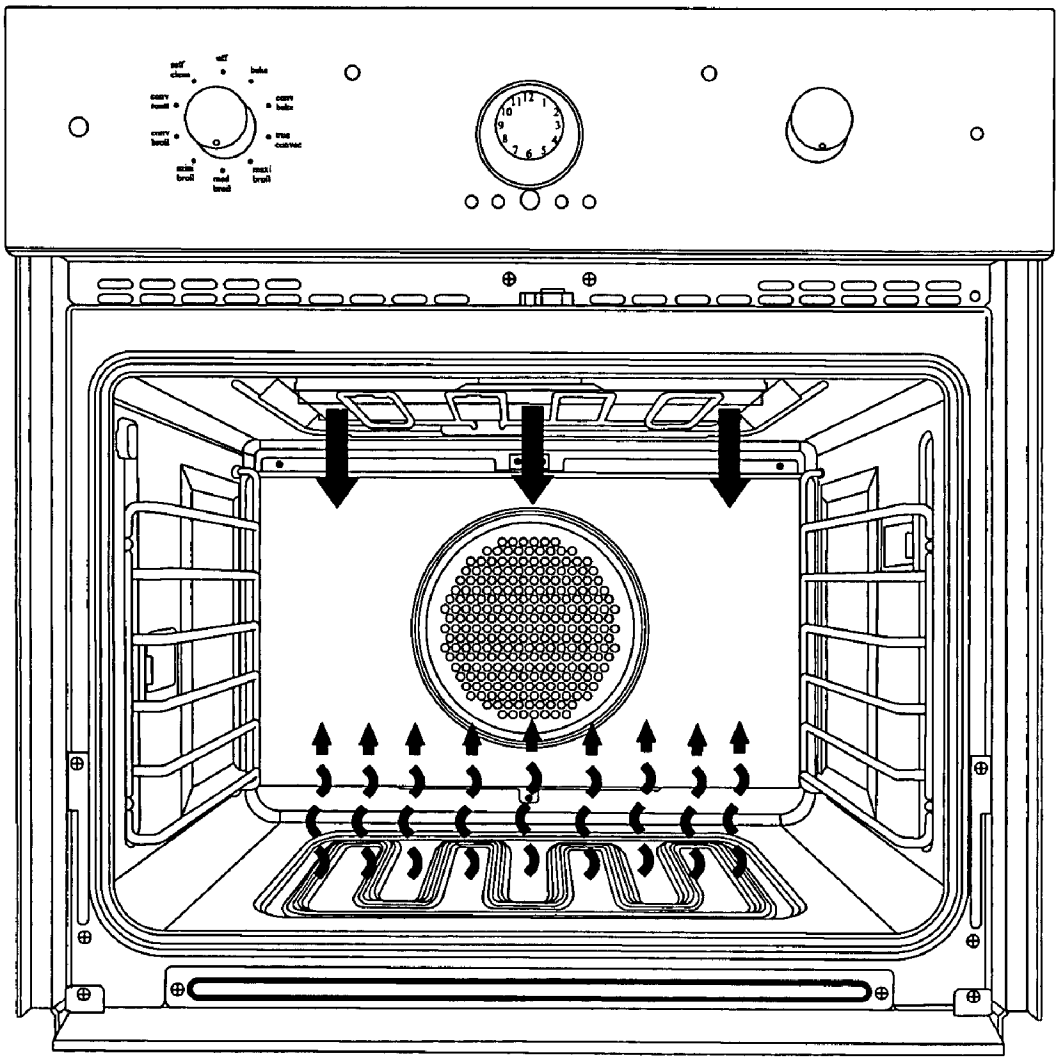

FIGS. 15A-C show an exemplary fast preheat operation sequence. As shown progressively from FIG. 15A to 15B to 15C, preheating of the oven 10 prior to the start of baking is shown sequentially as the oven approaches the desired or set temperature. Generally, the method of preheat as shown in FIGS. 15A-15C are provided as an example to show preheat of an oven set in the bake mode of operation. In this bake mode of operation, only a small percentage of the capacity of the broil element is used, as shown in FIG. 15C.

As shown in FIG. 15A, at the start of preheat, generally the oven is between room temperature and approximately 150° F. The broil elements are initiated and operate at full power to radiate heat to the oven cavity 12 and to raise quickly the oven temperature. At the start of preheat shown in FIG. 15A, the bake elements operate for approximately 50% of the time to gently warm the oven floor. The average power output or use of the oven 10 in the preheat step shown in FIG. 15A is approximately 5500 watts.

The preheat sequence continues in FIG. 15B with the temperature in the oven between approximately 150° F. and approximately 250° F. Within this temperature range, the broil elements are reduced to operate only approximately 70% of the time. The bake elements generally are operated for 50% of the time as the oven floor continues to increase in temperature. In the preheat step shown in FIG. 15B, the average power consumed by the oven 10 is approximately 4400 watts.

As shown in FIG. 15C, preheat generally has completed and baking has started. The oven generally is between approximately 250° F. and approximately 350° F. with the broil elements being further reduced to operate approximately 25% of the time. Operation of the bake elements is then increased to heat approximately 80% of the time. After the set point temperature set by the user is reached, the oven proceeds to the cycling described above under the mode of operation selected by the user. The average power consumed in the step of FIG. 15C is approximately 3400 watts.

As shown in FIGS. 15A-15C, preheating in the bake mode of operation shifts the heat source over the course of preheating from predominately the broil element (or elements in the "cold" oven) to predominately bake elements as the oven warms. The shift of heat source allows preparation of the oven for baking mode of operation selected by the user. Accordingly, the preheating steps shown in FIGS. 15A-15C allow for fast preheat through use of multiple heating elements and by shifting the heat source from broil to bake as the oven approaches the set temperature.

As a further example, the cycling for the Tru Convec mode of operation will now be described. The Tru Convec cooking mode typically begins with the user selecting the Tru Convec mode, generally through a mode selector on the appliance panel 20. The user also generally sets a set point temperature on the instrument panel 20. After the user has selected the Tru Convec mode and set the temperature, the convection fan begins to rotate in a first direction, for example in a clockwise direction, and, subsequently, in the opposite, here counterclockwise, direction until the user stops the cooking mode. The heating elements cycle on and off as described until the set point is reached. A temperature sensor (typically an RTD (resistance temperature detector)) in the oven 10 measures the oven temperature throughout the selected cycle. In this exemplary cycle of Tru Convec cooking mode, the fan rotates in a clockwise direction for approximately 60 seconds. The fan is then paused for approximately 10 seconds before rotating in the counterclockwise direction for approximately 60 seconds. The fan then continues in this alternating rotation sequence until the preheat phase is complete and the set point temperature within the oven cavity 12 is reached. Once the oven 10 has reached its set point temperature, the cooking phase begins. In the cooking phase in the Tru Convec cooking mode, the fan rotates for 45 seconds in one direction, such as in the clockwise direction. After a 10 second reset delay, the fan reverses direction to operate for approximately 45 seconds, for example, in the counterclockwise direction. This alternating sequence of 45 seconds clockwise, 10 seconds off, 45 seconds counterclockwise, 10 seconds off, continues until the user stops the cooking mode. The times of operation in the clockwise and counterclockwise directions and the pause between directions can be varied to allow for shorter fan operation periods or longer fan operation periods. Shorter fan periods (such as 45 seconds) are used during "cook" modes to reduce uneven cooking. Longer fan periods (60 seconds) are used during preheat to reduce preheat time and to reduce motor wear.

Since the cycling of the operation of the heating elements depends upon the cooking mode selected, each of the exemplary modes of operation detailed above can operate under different heating element cycles. For example, in the Tru Convec mode, the convection heating element is the primary source of heat for the oven. As long as the temperature in the oven cavity 12 is below the set point temperature, the convection element generally remains on. The convection elements surrounding the fan also is activated when the temperature falls below the set point during the "cook" phase of the selected mode of operation.

The various exemplary cooking modes as provided in FIGS. 7-14 generally can be utilized by a user to cook specific foods at specific times to achieve specific results. Examples of foods capable of benefiting from certain modes of operation are provided for each mode of operation. In the bake mode of operation, a user generally is interested in single rack baking of foods, such as breads, cakes, cookies, pastries, pies, entrees, or vegetables. In the convection bake mode of operation, a user generally is interested in multi-rack baking for heavier or frozen foods, such as multiple frozen pies, pizzas, entrees, or vegetables. In the Tru Convec mode of operation, the user generally is interested in multi-rack baking of multiple racks of foods, such as breads, cakes, or cookies, with up to 6 racks of cookies, for example, capable of being cooked at once.

In the high broil mode of operation, a user generally is interested in cooking meats, such as dark meats, of an approximate one inch or more thickness, where rare or medium preparation is desired. In the medium broil mode of operation, a user generally is interested in cooking meats, such as white meats, chicken or meats greater than approximately 1-inch thickness that would be over-browned in the high broil mode of operation. In the low broil mode of operation, users generally are interested in delicate broiling of items, such as meringue.

In the convection broil mode of operation, users generally are interested in cooking thicker meats at faster rates than a regular broil and with less generation of smoke. In a convection roast mode of operation, users generally are interested in large, dense items, such as whole turkeys, whole chickens, hams, or the like.

The present oven 10 also can be provided with a self-clean feature or mode of operation during which the door lock assembly 15 generally is engaged and the heating elements are operated at high wattage to clean the oven cavity 12. Many other benefits of the present oven and modifications hereto are contemplated. For example, the bake elements can be profiled and hidden, controllers and/or access boards can be provided to accessorize or provide areas of attachment for the oven, such as a controller that will permit use of a pizza stone, and the door can be adjustable without requiring removal of the door.

The invention has been described in terms of preferred configurations and methodologies considered by the inventors to be the best modes of carrying out the invention. These preferred embodiments are presented as examples only, and should not be construed as limiting the scope of the invention. A wide variety of additions, deletions, and modifications to the illustrated and described embodiments might be made by those of skill in the art without departing from the spirit and scope of the invention, which is circumscribed only by the claims.

What is claimed is:

1. An airflow control system for an oven having an oven cavity partially bounded by a rear wall, a first side wall, and a second side wall, the first side wall and the second side wall being parallel, the airflow control system comprising:

a baffle housing disposed in the oven cavity, the baffle housing spaced from the rear wall and extending to, but not intersecting, the first side wall and the second side wall, the baffle housing being spaced from the first side wall by a first outlet and being spaced from the second side wall by a second outlet;

a reversible fan in the cavity disposed between the baffle housing and the rear wall, the fan having a first operating mode for directing a first flow of air when the fan is operated in a clockwise direction and a second operating mode for directing a second flow of air when the fan is operated in a counterclockwise direction; and the baffle housing including an upper baffle and a lower baffle disposed between the baffle housing and the rear wall, the first outlet bounded at least partially by the upper baffle, lower baffle, baffle housing, rear wall, and first side wall, the second outlet bounded at least partially by the upper baffle, lower baffle, baffle housing, rear wall, and second side wall, the upper baffle and the lower baffle being configured to direct the first flow of air, along the rear wall to exit the first outlet prior to intersecting the first side wall, to a first region of the cavity and to direct the second flow of air, along the rear wall to exit the second outlet prior to intersecting the second side wall, to a second region of the cavity.

2. The system of claim 1 wherein the baffle directs the first flow of air to a first region of the oven cavity in the first operating mode and the baffle directs the second flow of air to a second region of the oven cavity in the second operating mode.

3. The system of claim 1 wherein the system includes a control means and a motor that controls switching of the fan between the first and second operating modes.

4. The system of claim 3 wherein the control means is capable of alternating the operation of the fan from the first operating mode to the second operating mode and from the second operating mode to the first operating mode.

5. The system of claim 1 wherein a pause is included between switching the fan from the first operating mode to the second operating mode or from the second operating mode to the first operating mode.

6. The system of claim 2 wherein the baffle directs a majority of air to the second region of the cavity when the system switches from the first operating mode to the second operating mode.

7. The system of claim 2 wherein the baffle directs a majority of air to the first region of the cavity when the system switches from the second operating mode to the first operating mode.

8. The system of claim 1 wherein the first and second outlets include bottom openings and side openings in airflow communication with the cavity of the oven and wherein the side openings are larger than the bottom openings.

9. The system of claim 1 wherein the fan is surrounded by a heating element.

10. The system of claim 1 wherein the fan includes a fan blade that is approximately eight inches in diameter.

11. An airflow control system for an oven having an oven cavity partially bounded by a rear wall, a first side wall, and a second side wall, the airflow control system comprising:

a fan disposed in the cavity, the fan being separated from the cavity by a grill cover through which the fan draws air during operation; the fan having a first operating mode for generating a first flow of air and a second operating mode for generating a second flow of air; and, a baffle housing including a first baffle and a second baffle adjacent the fan configured to direct the first flow of air to a first region of the cavity and to direct the second flow of air to a second region of the cavity; the baffle housing having a first inlet proximate the fan and a second inlet proximate the fan; the baffle housing disposed in the cavity proximate the rear wall and extending to, but not intersecting, the first side wall or the second side wall;

wherein the baffle housing has a first outlet and a second outlet, the first outlet being distal the fan and allowing air to exit the baffle housing along the rear wall prior to intersecting the first side wall of the oven cavity and the second outlet being distal the fan and allowing air to exit the baffle housing along the rear wall prior to intersecting the second side wall of the oven cavity, the first and second side walls being substantially parallel;

wherein, during the first operating mode, a first air flowpath is created between the first inlet and the first outlet and, during the second operating mode, a second air flowpath is created between the second inlet and the second outlet;

wherein the baffle housing seals off areas from the cavity of the oven where air does not flow; the sealed off areas being adjacent either the first flowpath or the second flowpath.

12. The system of claim 11 wherein the baffle housing includes at least two sealed off areas.

13. The system of claim 12 wherein one of the two sealed off area seals the top of the baffle housing.

14. The system of claim 12 wherein an other of the two sealed off area seals a central portion of the bottom of the baffle housing.

15. The system of claim 11 wherein the first and second outlets include bottom openings and side openings in airflow communication with the cavity of the oven.

16. The system of claim 11, wherein the first outlet is smaller than the first inlet.

17. The system of claim 11, wherein the second outlet is smaller than the second inlet.

18. The system of claim 17 wherein the first and second outlets are generally directed at a floor of the oven.

19. An airflow control system for an oven having an oven cavity, the airflow control system comprising:

a fan disposed in the cavity, the fan being separated from the cavity by a grill cover through which the fan draws air during operation; the fan having a first operating mode for generating a first flow of air and a second operating mode for generating a second flow of air; and, a baffle housing including a first baffle and a second baffle adjacent the fan configured to direct the first flow of air to a first region of the cavity and to direct the second flow of air to a second region of the cavity; the first baffle having a first inlet proximate the fan; the second baffle having a second inlet proximate the fan;

wherein the first baffle has a first outlet and the second baffle has a second outlet, the first outlet being distal the fan and proximate a first side wall of the oven cavity and the second outlet being distal the fan and proximate a second side wall of the oven cavity, the first and second side walls being substantially parallel;

wherein, during the first operating mode, a first air flowpath is created between the first inlet and the first outlet and, during the second operating mode, a second air flowpath is created between the second inlet and the second outlet;

wherein the baffle housing seals off areas from the cavity of the oven where air does not flow; the sealed off areas being adjacent either the first flowpath or the second flowpath;

wherein the first and second outlets include bottom openings and side openings in airflow communication with the cavity of the oven;

wherein the side openings are larger than the bottom openings.

20. An oven comprising:

an oven cavity having a rear wall, a baffle housing in the oven cavity, the baffle housing being spaced from and extending along the rear wall;

a reversible fan disposed in the cavity, the fan having a first operating mode for directing a first flow of air when the fan is operated in a clockwise direction and a second operating mode for directing a second flow of air when the fan is operated in a counterclockwise direction; and the baffle housing including at least one baffle adjacent and extending away from the fan configured to direct the first flow of air to a first region of the cavity and to direct the second flow of air to a second region of the cavity, wherein when the fan is operated in the clockwise direction, at least a portion of the first flow of air travels along the baffle between the baffle housing and the rear wall to a first outlet, the first outlet being distal the fan and at least partially bounded by the baffle, baffle housing, rear wall, and a first side wall of the oven cavity; the baffle allowing air to exit the baffle housing prior to intersecting the first side wall and not proximate the fan.

21. The oven of claim 20 wherein the baffle directs the first flow of air to the first region in the first operating mode and the baffle directs the second flow of air to the second region in the second operating mode.

22. The oven of claim 20 further including a control means and a motor that controls switching of the fan between the first and second operating modes.

23. The system of claim 14 wherein the control means is capable of alternating the operation of the fan from the first operating mode to the second operating mode and from the second operating mode to the first operating mode.

24. The oven of claim 20 wherein, the first outlet includes a bottom opening and a side opening in airflow communication with the cavity of the oven and wherein the side opening is larger than the bottom opening.

25. A method of controlling airflow in an oven having an oven cavity, the oven cavity including a rear wall, a baffle housing, a first side wall, and a second side wall adjacent the rear wall, the baffle housing being spaced from and at least partially coextensive with the rear wall, the method comprising:

operating a fan disposed in the cavity in a first operating mode in a clockwise direction to generate a first flow of air; directing the first flow of air to a first region of the cavity with a first baffle and a second baffle disposed adjacent the fan, the first flow of air entering the baffle housing proximate the fan and exiting the baffle housing prior to intersecting the first side wall and distal the fan;

operating the fan in a second operating mode in a counterclockwise direction to generate a second flow of air; and directing the second flow of air to a second region of the cavity with the first and the second baffle; the first baffle and the second baffle being between the baffle housing and the rear wall, the second flow of air exiting the baffle housing prior to intersecting the second side wall.

26. The method of claim 25 wherein the fan is controlled by a motor to switch between the first and second operating modes.

27. The method of claim 25 wherein the method further comprises:

pausing operation of the fan between the first and second operating modes.

28. The method of claim 25 wherein, the second flow of air exits the baffle housing through a side opening and a bottom opening, the side opening being larger than the bottom opening.

29. An airflow control system for an oven having an oven cavity partially bounded by a rear wall, a first side wall, and a second side wall, the rear wall and the first side wall intersecting at a first intersection, the rear wall and the second side wall intersecting at a second intersection, the airflow control system comprising:

a reversible fan disposed between a baffle housing and the rear wall of the cavity, the fan having a first operating mode for generating a first flow of air when the fan is operated in a clockwise direction and a second operating mode for generating a second flow of air when the fan is operated in a counterclockwise direction; the baffle housing extending along the rear wall between the first intersection and the second intersection, but the baffle housing does not extend to the first intersection or the second intersection; and the baffle housing including a first baffle and a second baffle configured to direct the first flow of air to a first region of the cavity and to direct the second flow of air to a second region of the cavity, the first flow of air being directed away from the fan to exit the baffle housing prior to the first intersection, the second flow of air being directed away from the fan to exit the baffle housing prior to the second intersection; the first baffle and the second baffle disposed between the baffle housing and the rear wall.

30. An airflow control system for an oven having an oven cavity partially bounded by a rear wall, a first side wall, and a second side wall, and a baffle housing spaced from and partially coextensive with the rear wall, the airflow control system comprising:

a reversible fan disposed between the baffle housing and the rear wall of the cavity, the fan generating a first flow of air when the fan is operated in a clockwise direction and a second flow of air when the fan is operated in a counterclockwise direction; and a first baffle and a second baffle between the baffle housing and the rear wall configured to direct the first flow of air away from the fan to a first region of the cavity and the second flow of air away from the fan to a second region of the cavity; the first flow of air exiting the baffle housing at a first outlet along the rear wall prior to intersecting the first side wall; the second flow of air exiting the baffle housing at a second outlet along the rear wall prior to intersecting the second side wall;

wherein the first outlet includes bottom openings and side openings, the side openings being larger than the bottom openings.

31. An airflow control system for an oven having an oven cavity, the airflow control system comprising:

a reversible fan disposed between a baffle housing and the rear wall of the cavity, the fan having a first operating mode for generating a first flow of air in a clockwise direction when the fan is operated in the first direction and a second operating mode for generating a second flow of air in a counterclockwise direction when the fan is operated in the second direction; and the baffle housing extending along the rear wall to a first outlet proximate a first wall and a second outlet proximate a second wall; the first outlet and the second outlet being distal the fan; the first wall and the second wall being adjacent and perpendicular the rear wall; the baffle housing including at least one baffle adjacent the fan configured to direct the first flow of air out the first outlet and to direct the second flow of air out the second outlet; the at least one baffle allowing air to exit the first or second outlet proximate, but prior to intersecting, the first or second wall and not proximate the fan;

wherein the first outlet includes bottom openings and side openings, the side openings being larger than the bottom openings.

32. An airflow control system for an oven having an oven cavity, the cavity partially bounded by a rear wall and at least one side wall, the airflow control system comprising:

a reversible fan disposed between a baffle housing and the rear wall of the cavity, the fan having a first operating mode for generating a first flow of air when the fan is operated in a clockwise direction and a second operating mode for generating a second flow of air when the fan is operated in a counterclockwise direction; and the baffle housing including at least one baffle adjacent the fan; the baffle housing extending along the rear wall with the at least one baffle disposed between the baffle housing and rear wall; the at least one baffle being configured to direct the first flow of air to a first region of the cavity and to direct the second flow of air to a second region of the cavity; the at least one baffle having a first inlet proximate the fan and a first outlet distal the fan and proximate the at least one side wall of the cavity; the first flow of air exiting the first outlet along the rear wall prior to intersecting the at least one side wall.

* * * * *